US005603652A

United States Patent [19]

Rothschild et al.

[11] Patent Number: 5,603,652

[45] Date of Patent: Feb. 18, 1997

[54] DOLL ASSEMBLY

[76] Inventors: Omri Rothschild, 16 Barak Street, Zahala, Tel Aviv 69933, Israel; Roni Raviv, 7 Maccabi Street, Nesa Ziona 74046, Israel

[21] Appl. No.: 493,518

[22] Filed: Jun. 22, 1995

[51] Int. Cl.[6] ..... A63H 5/00

[52] U.S. Cl. ..... 446/130; 446/72; 446/81; 446/297; 446/485

[58] Field of Search ..... 446/72, 81, 130, 446/175, 297, 318, 408, 485; 434/307 R, 307 A, 319

[56] References Cited

U.S. PATENT DOCUMENTS

| | | | |
|---|---|---|---|
| 3,223,412 | 12/1965 | Freeman | 446/485 |
| 3,232,004 | 2/1966 | Felsher | 446/130 |
| 3,266,187 | 8/1966 | Felsher | 446/130 |
| 3,798,833 | 3/1974 | Campbell | 446/130 |
| 3,867,786 | 2/1975 | Greenblatt | 446/130 |
| 4,521,205 | 6/1985 | Spector . | |
| 4,840,602 | 6/1989 | Rose | 446/297 |
| 5,279,514 | 1/1994 | Lacombe | 446/175 |

FOREIGN PATENT DOCUMENTS

| | | | |
|---|---|---|---|
| 1248355 | 1/1989 | Canada | 446/297 |
| 2645770 | 10/1990 | France | 446/175 |
| 2196545 | 5/1988 | United Kingdom | 446/130 |

*Primary Examiner*—Robert A. Hafer
*Assistant Examiner*—Jeffrey D. Carlson
*Attorney, Agent, or Firm*—Christie, Parker & Hale, LLP

[57] ABSTRACT

A doll assembly has a toy figure and an audio output generator to simulate the singing of a song by the toy figure. A microphone, capable of providing audio input to the audio output generator, includes a light source modulated by the audio output generator when placed in propinquity with the toy figure. The modulated light creates the sensation that the toy figure is moving its lips in synchronization with the song.

21 Claims, 13 Drawing Sheets

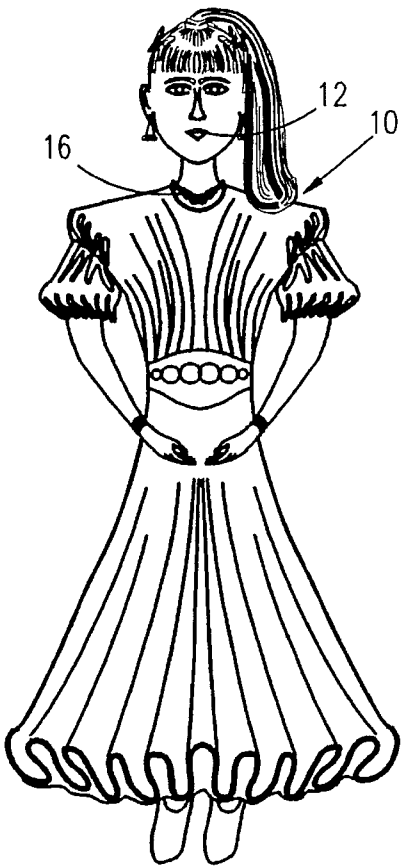
FIG. 1B
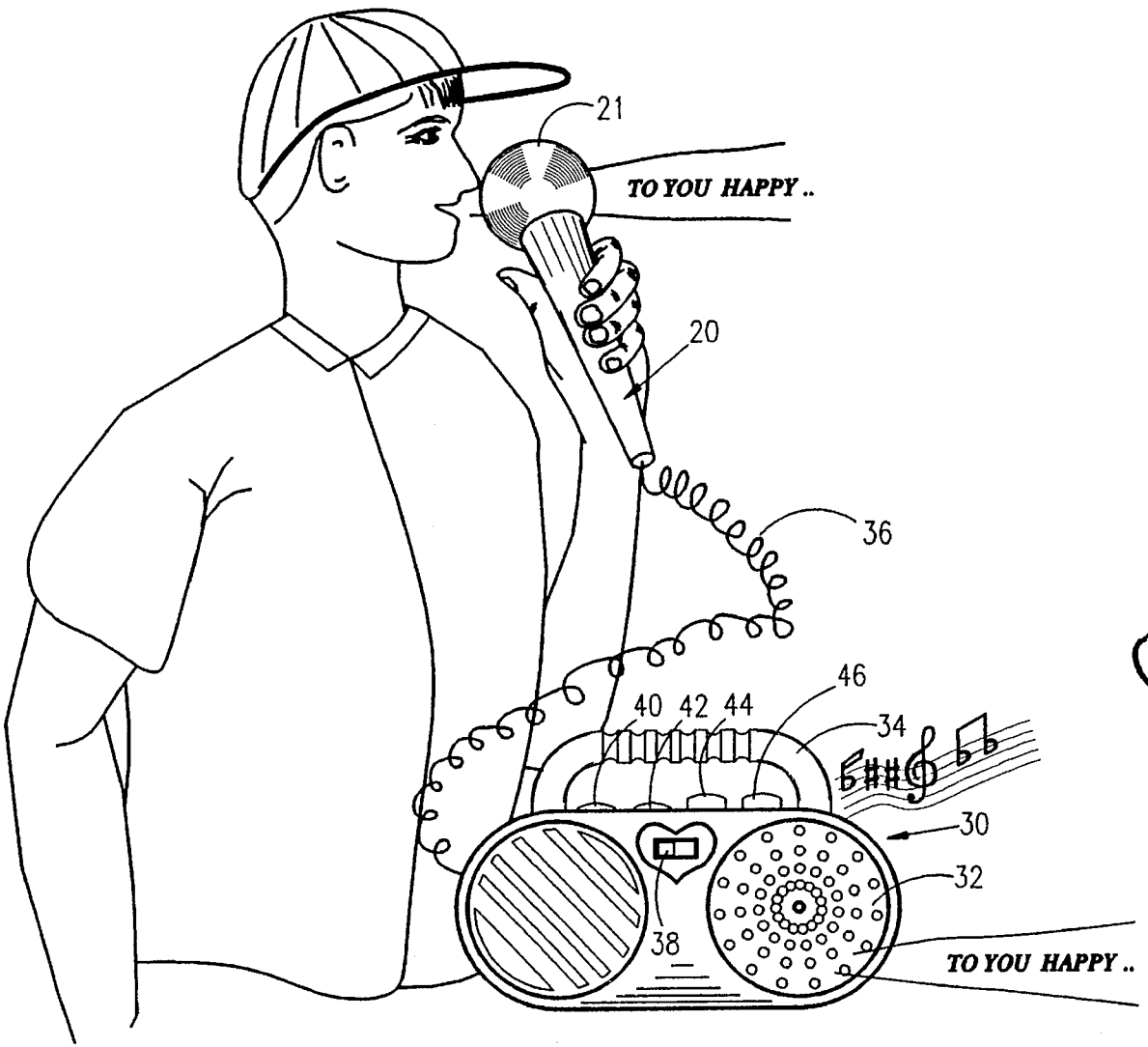

DOLL ASSEMBLY

FIELD OF THE INVENTION

The present invention relates to toys generally and more particularly to dolls and toys including dolls.

BACKGROUND OF THE INVENTION

Various types of dolls are known in the art. Talking dolls are also known and may incorporated reed switches which actuate a talking function in response to propinquity of a magnetic material.

There is known a product called "MAGIC HUSH LITTLE BABY" which is marketed by Irwin Toy Ltd. of Toronto, Canada, and includes a magnet in a baby bottle. A play sequence starts with the baby crying. When a child places the baby bottle in the baby's mouth, the crying stops and the baby makes gulping sounds.

SUMMARY OF THE INVENTION

The present invention seeks to provide an improved doll and toy assembly including a doll. The improved doll and toy assembly provide a novel interaction between a user, the doll and background audio output.

There is thus provided in accordance with a preferred embodiment of the present invention a synchronized audio output toy assembly including:

a toy figure; and an audio output generator operative to produce an audio output;

the audio output generator including at least first and second audio channels, the first audio channel being operative, when actuated, to provide a predetermined background audio output which is useful for time base synchronization, the second audio channel being operative, when actuated, to provide a predetermined foreground audio output in time base synchronization with the predetermined background audio output.

Preferably, the predetermined background audio output includes music and the predetermined foreground audio output includes voice.

In accordance with a preferred embodiment of the present invention a microphone is coupled to the audio output generator, the audio output generator being operative, when actuated, to provide an audio output of audio inputs received by the microphone together with the predetermined background audio output.

Preferably, the audio output generator is operative, when suitably actuated to simultaneously provide the predetermined foreground audio output, the predetermined background audio output and the audio output of audio inputs received by the microphone.

In accordance with a preferred embodiment of the present invention, the audio output generator includes user operative control enabling the predetermined foreground audio input to be provided selectably with the predetermined background audio input.

The user operative control preferably includes a propinquity switch operative to provide the predetermined foreground audio input in response to propinquity of a predetermined article to the toy figure. Preferably, the article is the microphone.

In accordance with a preferred embodiment of the present invention, the toy figure is a figure having a mouth and wherein the assembly also includes a modulated light source for illuminating the mouth, the modulated light source being illuminated in accordance with the foreground audio output.

There is also provided in accordance with a preferred embodiment of the present invention a synchronized audio output toy assembly including:

a toy figure having lips;

an audio output generator operative to produce an audio output; and a modulated light source for illuminating the mouth, the modulated light source being illuminated in accordance with the foreground audio output.

There is additionally provided in accordance with a preferred embodiment of the present invention a singing doll toy assembly including:

a doll including a mouth and having magnetic material in the vicinity of the mouth; and a microphone unit including a magnetically operated witch which is actuated when the microphone unit is placed in propinquity to the doll's mouth; and an audio output generator which is actuated by the magnetically operated switch.

In accordance with a preferred embodiment of the present invention, the microphone unit includes a light source which illuminates the vicinity of the doll's mouth when the microphone is actuated.

There is also provided in accordance with a preferred embodiment of the present invention a singing doll toy assembly including:

a doll including a mouth; and a microphone unit; and an audio output generator which is actuated by the microphone unit being placed in propinquity to the mouth of the doll, wherein the microphone unit includes a light source which illuminates the vicinity of the doll's mouth when the microphone unit is placed in propinquity to the mouth of the doll, There is additionally provided in accordance with a preferred embodiment of the present invention a singing doll toy assembly including:

a doll including a mouth; and a microphone unit; and an audio output generator operative to provide an output of music and to provide a synchronized overlay of prerecorded singing by the doll when the microphone unit is placed in propinquity to the mouth of the doll.

In accordance with a preferred embodiment of the present invention the microphone unit is also operative to pick up sounds produced by a user for amplification and output by the audio output generator, when the microphone unit is not placed in propinquity to the mouth of the doll.

In accordance with a preferred embodiment of the present invention the audio output generator includes user actuable controls enabling selection of music and voice outputs.

In accordance with one embodiment of the present invention, the doll may be an entirely conventional doll having a magnet located in the vicinity of its mouth. Alternatively the magnet may be located in an accessory, such as a necklace, which may be removably located in the vicinity of the doll's mouth.

BRIEF DESCRIPTION OF THE DRAWINGS

The present invention will be understood and appreciated more fully from the following detailed description, taken in conjunction with the drawings in which:

FIGS. 1A–1D are generalized illustrations of a singing doll toy assembly constructed and operative in accordance with a preferred embodiment of the present invention in four different stages of operation;

DETAILED DESCRIPTION OF A PREFERRED EMBODIMENT

Reference is now made to FIGS. 1A–1D, 2, 3 and 4, which illustrate a singing doll toy assembly constructed and operative in accordance with a preferred embodiment of the present invention. The singing doll toy assembly of the present invention preferably includes a doll 10, which may be an entirely conventional doll, including a mouth 12.

In accordance with a preferred embodiment of the present invention, magnetic material 14 is provided in the vicinity of the mouth. In accordance with one preferred embodiment of the present invention, illustrated in FIG. 4, the magnetic material 14 is located within the head of an otherwise conventional doll. Alternatively, the magnetic material may be contained within an ornament, such as a necklace 16, located in the vicinity of the doll's mouth.

Figure 3:
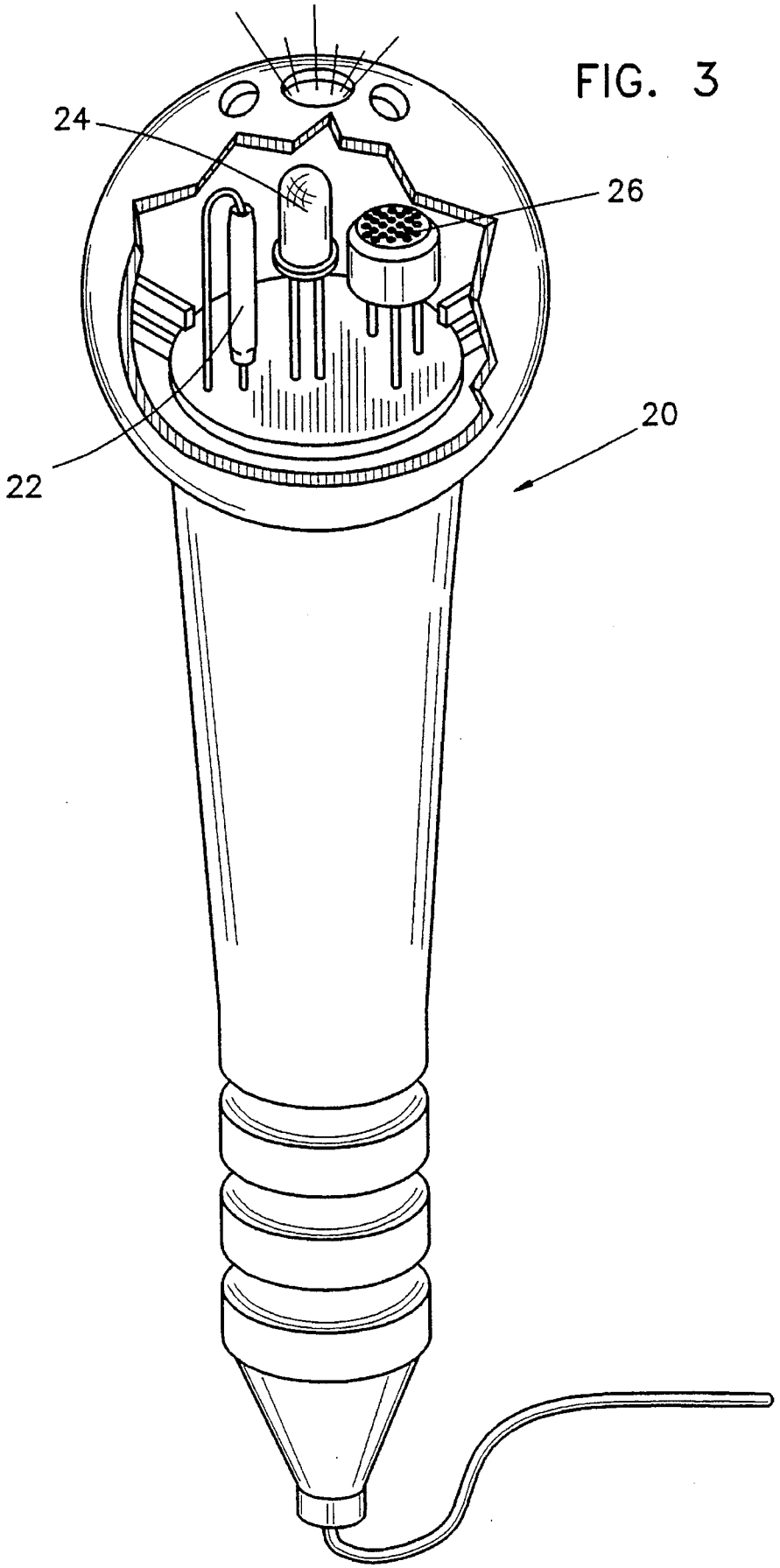
FIG. 3 is a simplified partially cut-away illustration of a microphone unit employed in the apparatus of FIGS. 1A–1D.
Figure 4:
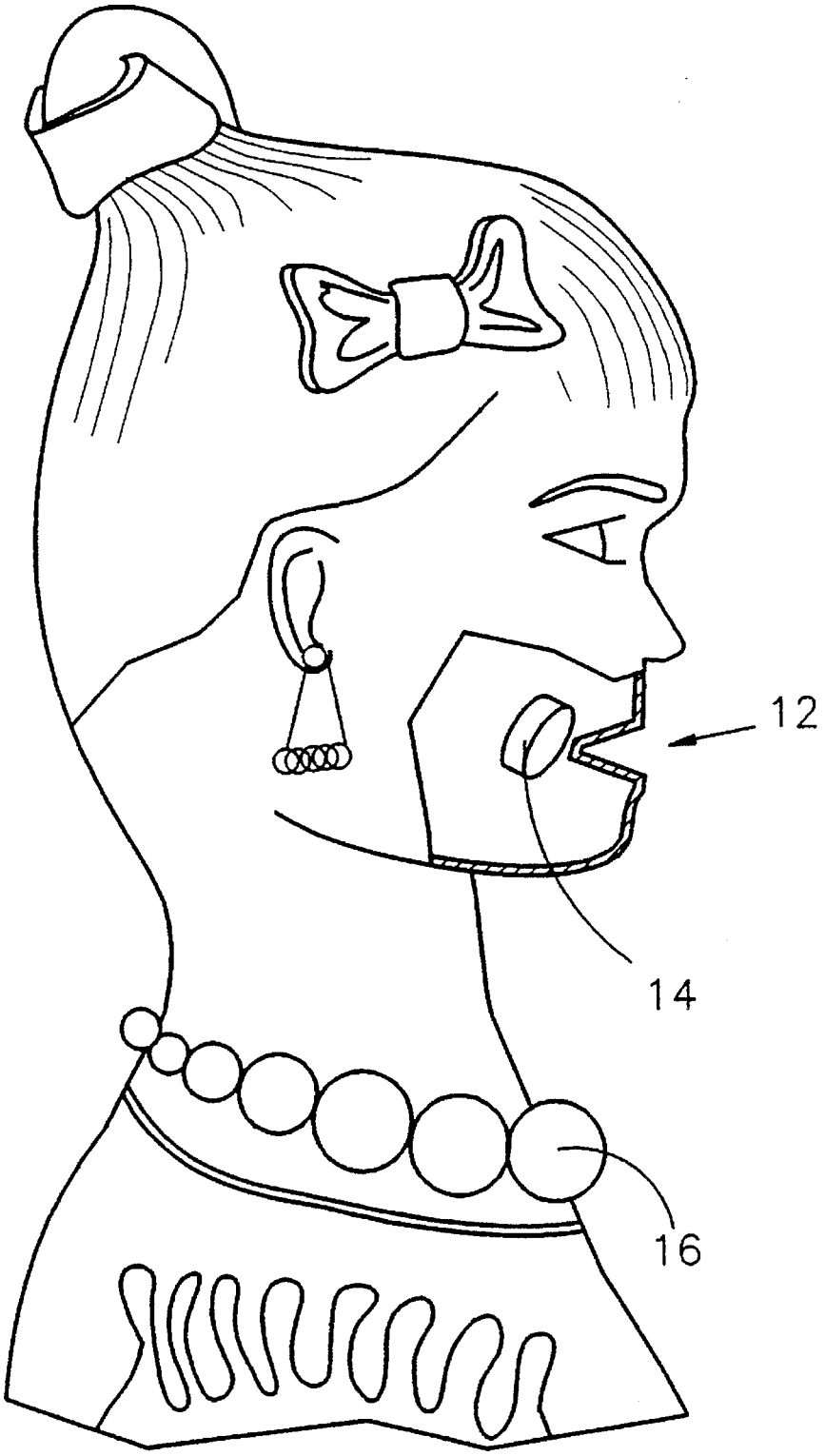
FIG. 4 is a simplified partially cut-away illustration of part of a doll employed in the apparatus of FIGS. 1A–1D.

The singing doll assembly also preferably comprises a microphone unit 20 preferably of the type illustrated generally in FIG. 3 and including a light and sound permeable housing 21 having disposed therein a magnetically operated switch 22 which s actuated when the microphone unit 20 is placed in propinquity to the doll's mouth 12.

In accordance with a preferred embodiment of the present invention, the microphone unit 20 also preferably includes a light source 24, such as an LED, which illuminates the vicinity of the doll's mouth when the microphone is actuated by closing of switch 22 and a microphone 26. In accordance with a preferred embodiment of the present invention, the output of the light source is modulated in accordance with a song sung by the doll or speech spoken by the doll. This illumination provides a visual sensation of lip movement when the doll is singing or speaking.

Figure 1A:
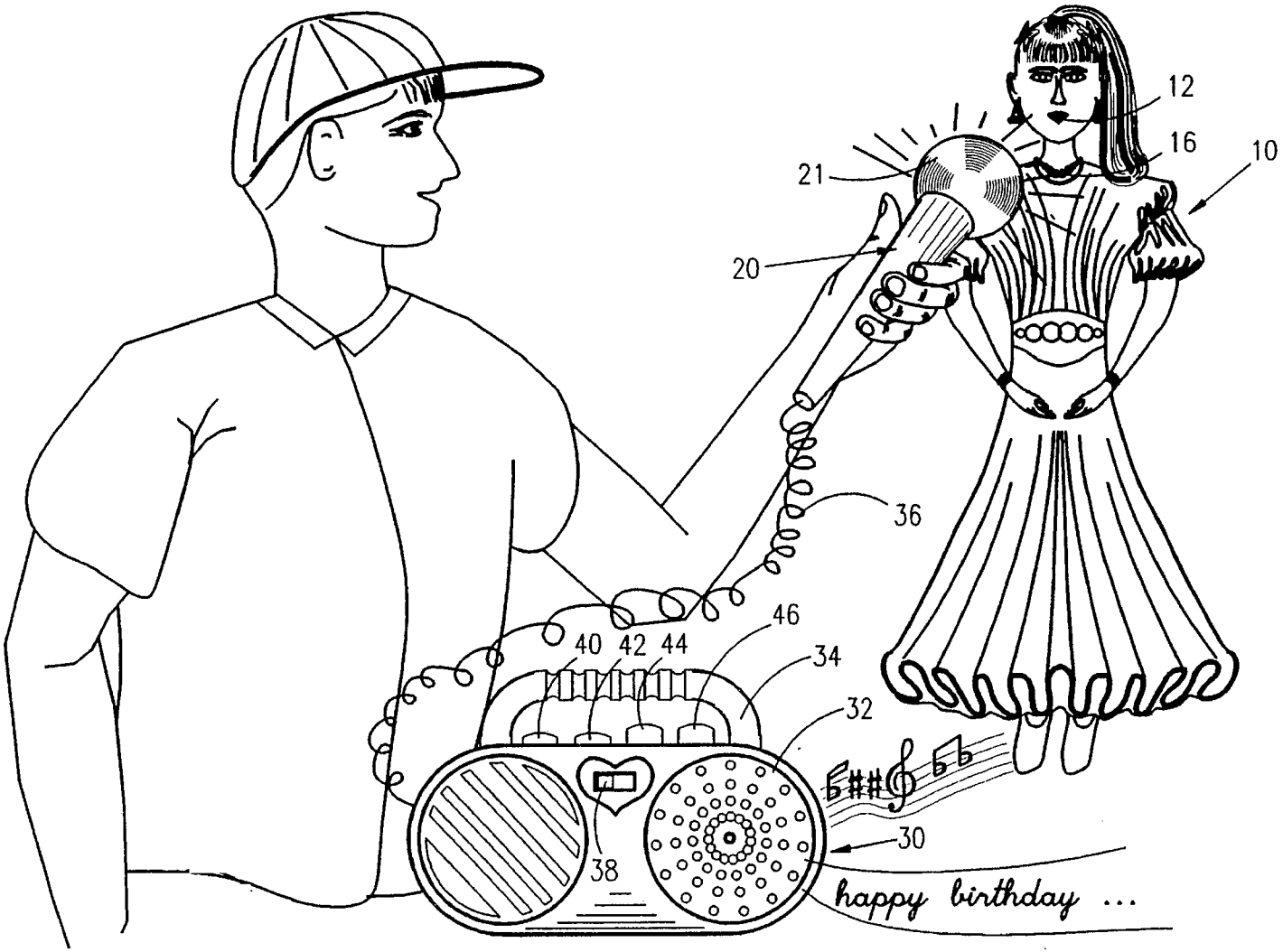
Figure 1C:
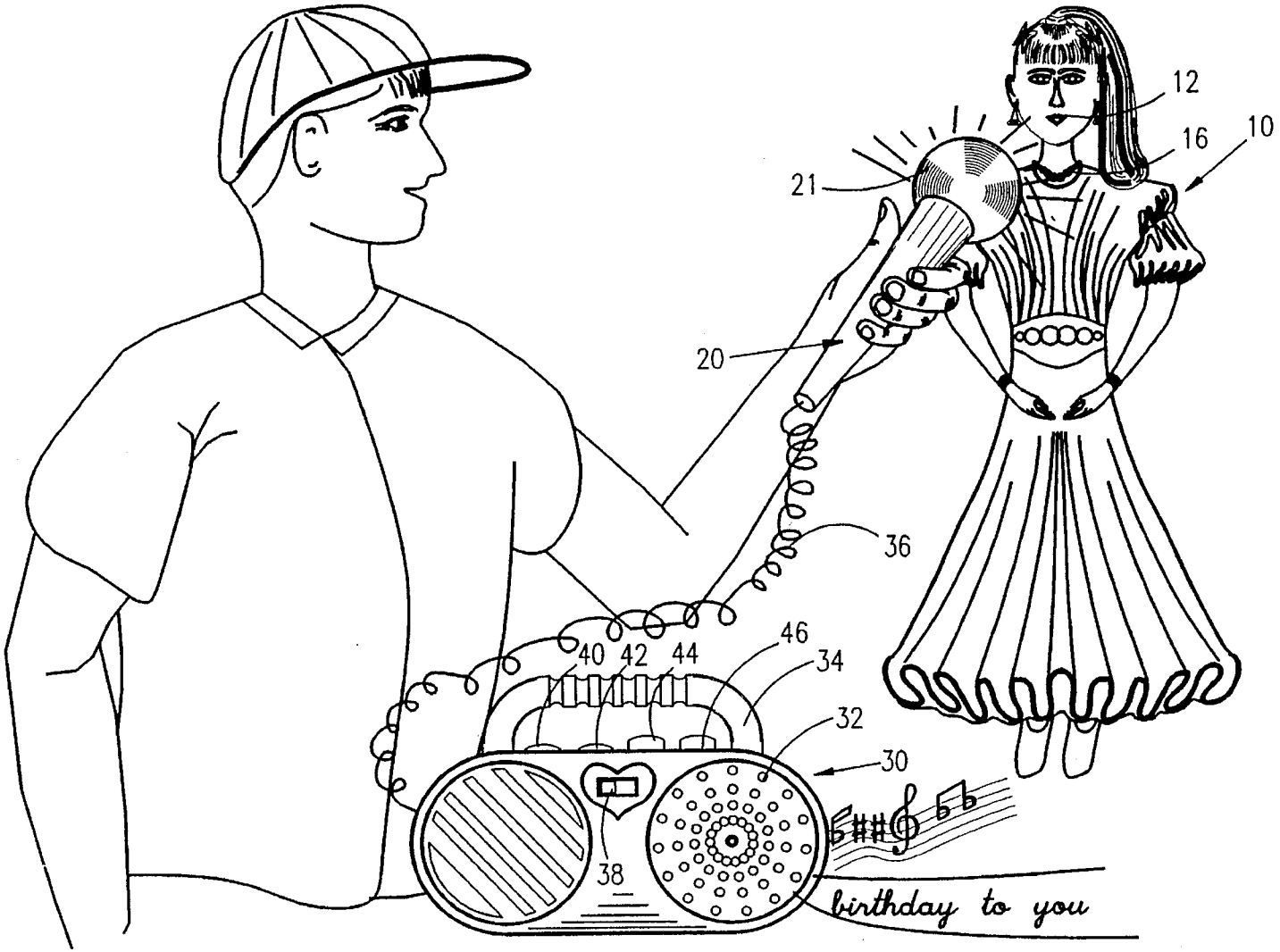
Figure 1D:
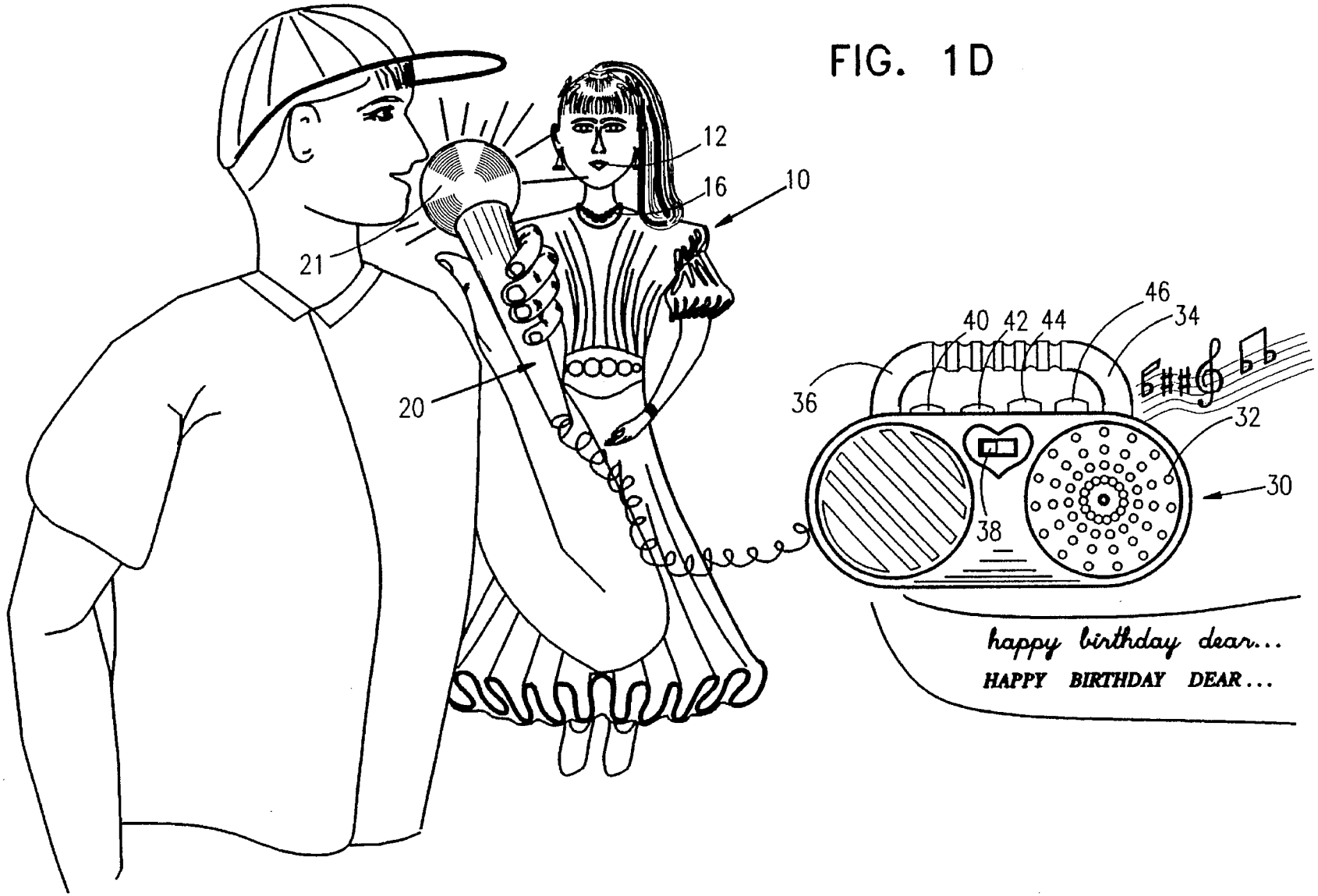
Figure 2:
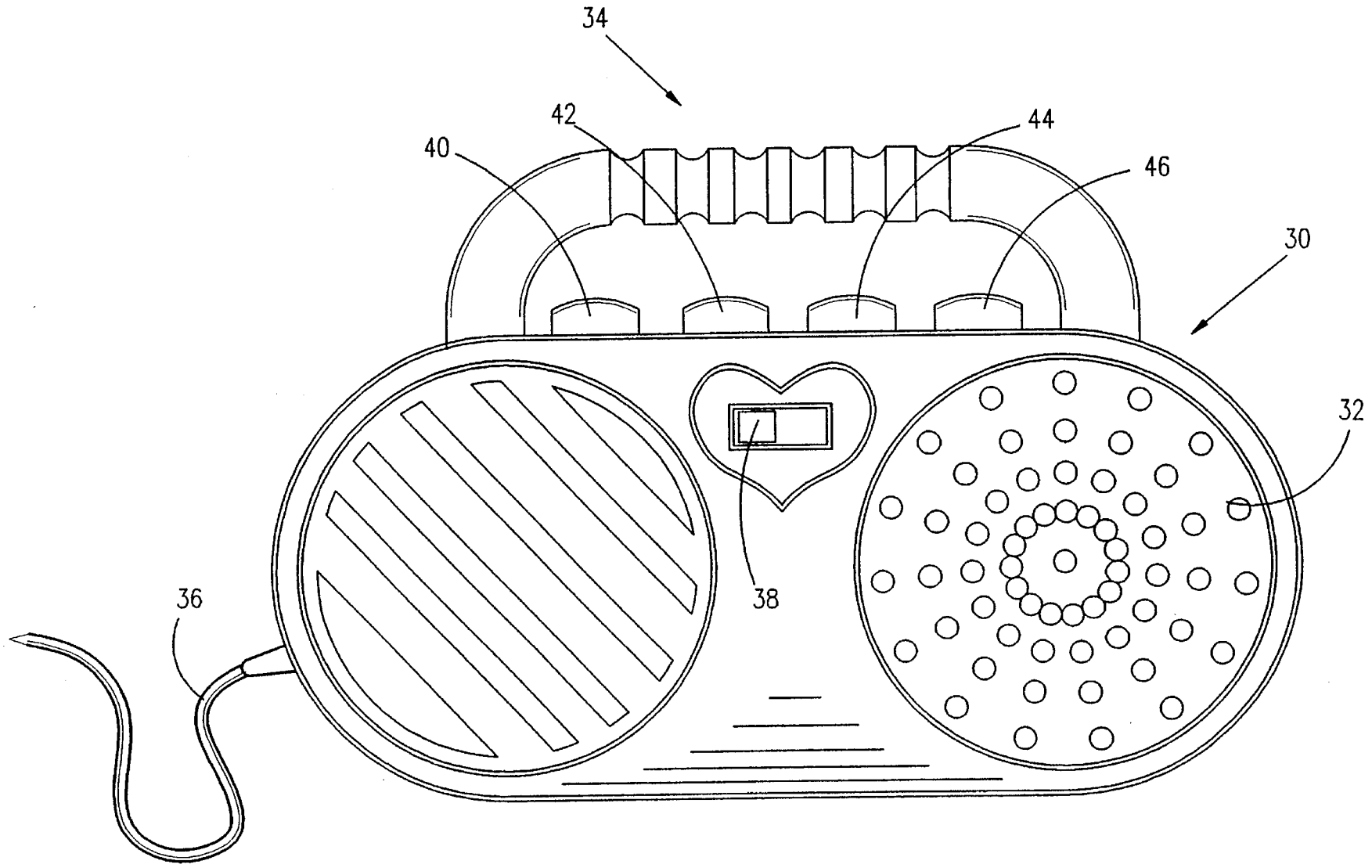
FIG. 2 is a pictorial illustration of an audio output assembly forming part of the singing doll toy assembly of FIGS. 1A–1D.

The singing doll assembly also includes an audio output generator 30, which is illustrated generally in FIG. 2. The audio output generator 30 may be configured in any desired suitable configuration and typically includes a housing 32 having a handle 34 associated therewith. Communicating with housing 32 is a cable 36 connected to the microphone unit 20.

The audio output generator 30 includes an LED operation indicator 38 and four function switches 40, 42, 44 and 46. Function switch 40 is an ON/OFF switch for the entire singing doll assembly. Function switches 42, 44 and 46 each correspond to a selectable piece of music.

Figure 7A:
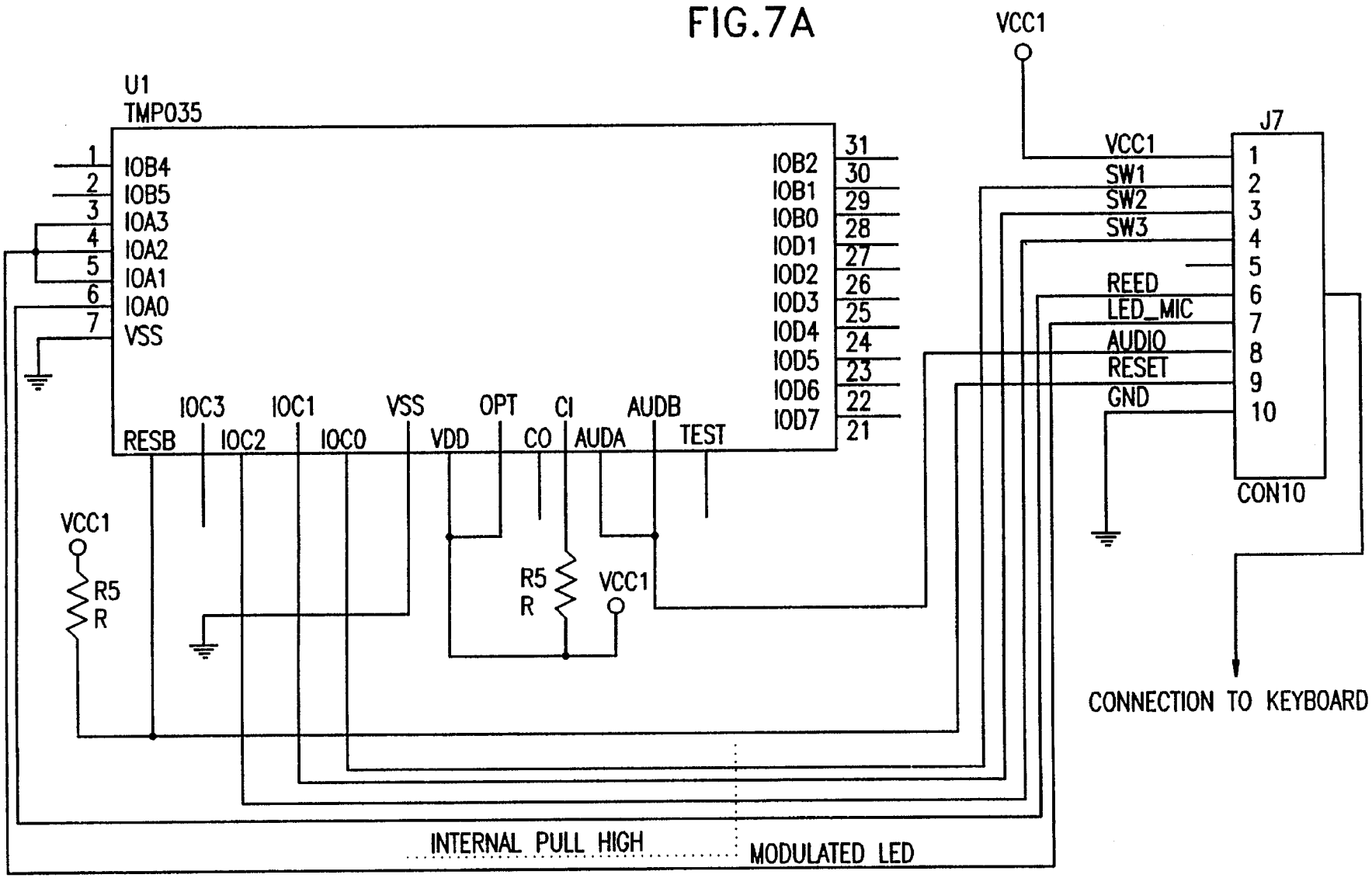
FIGS. 7A, 7B and 7C form an electrical schematic of the circuitry of audio output assembly of FIG. 2.
Figure 7B:
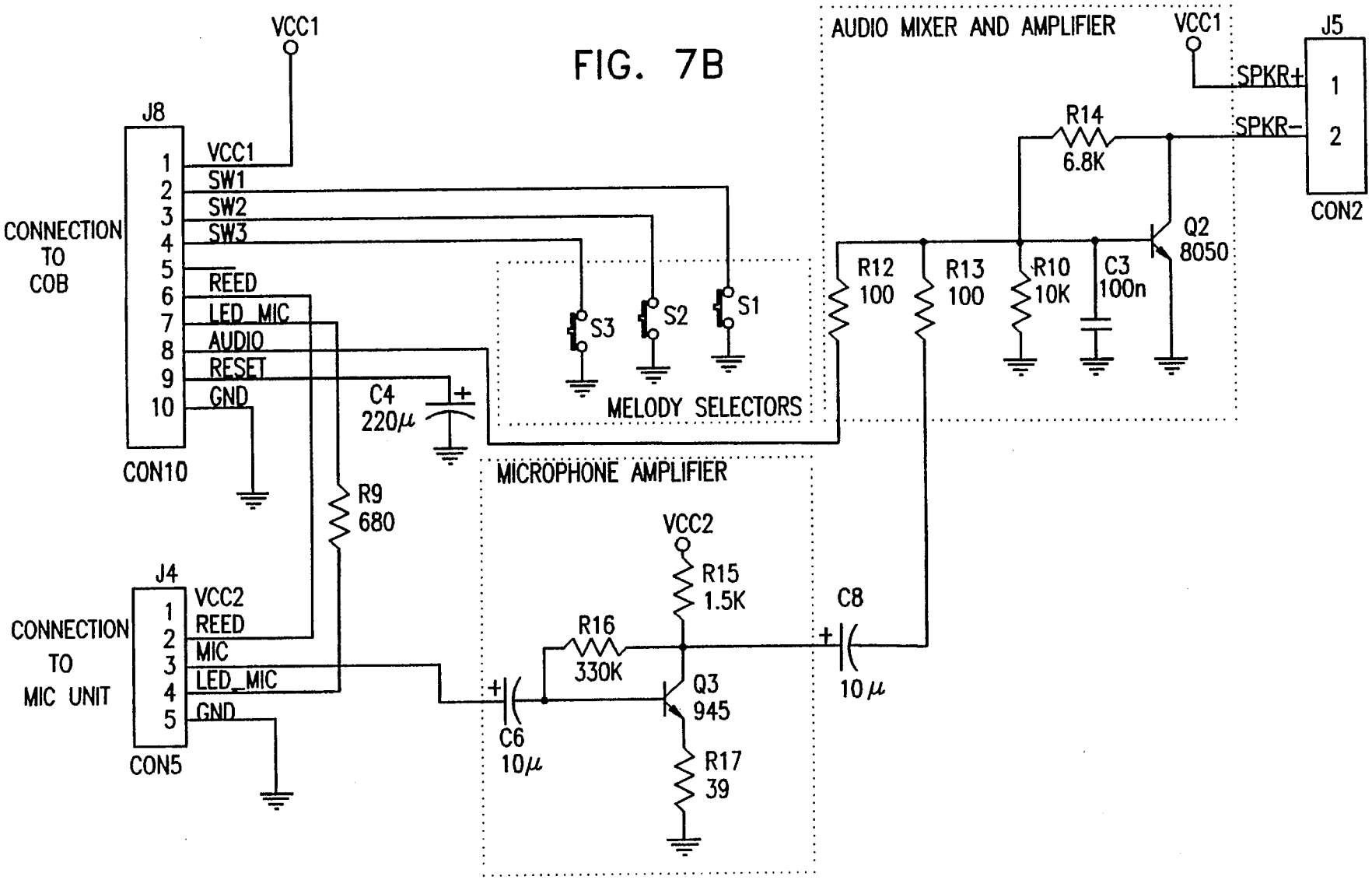
Figure 7C:
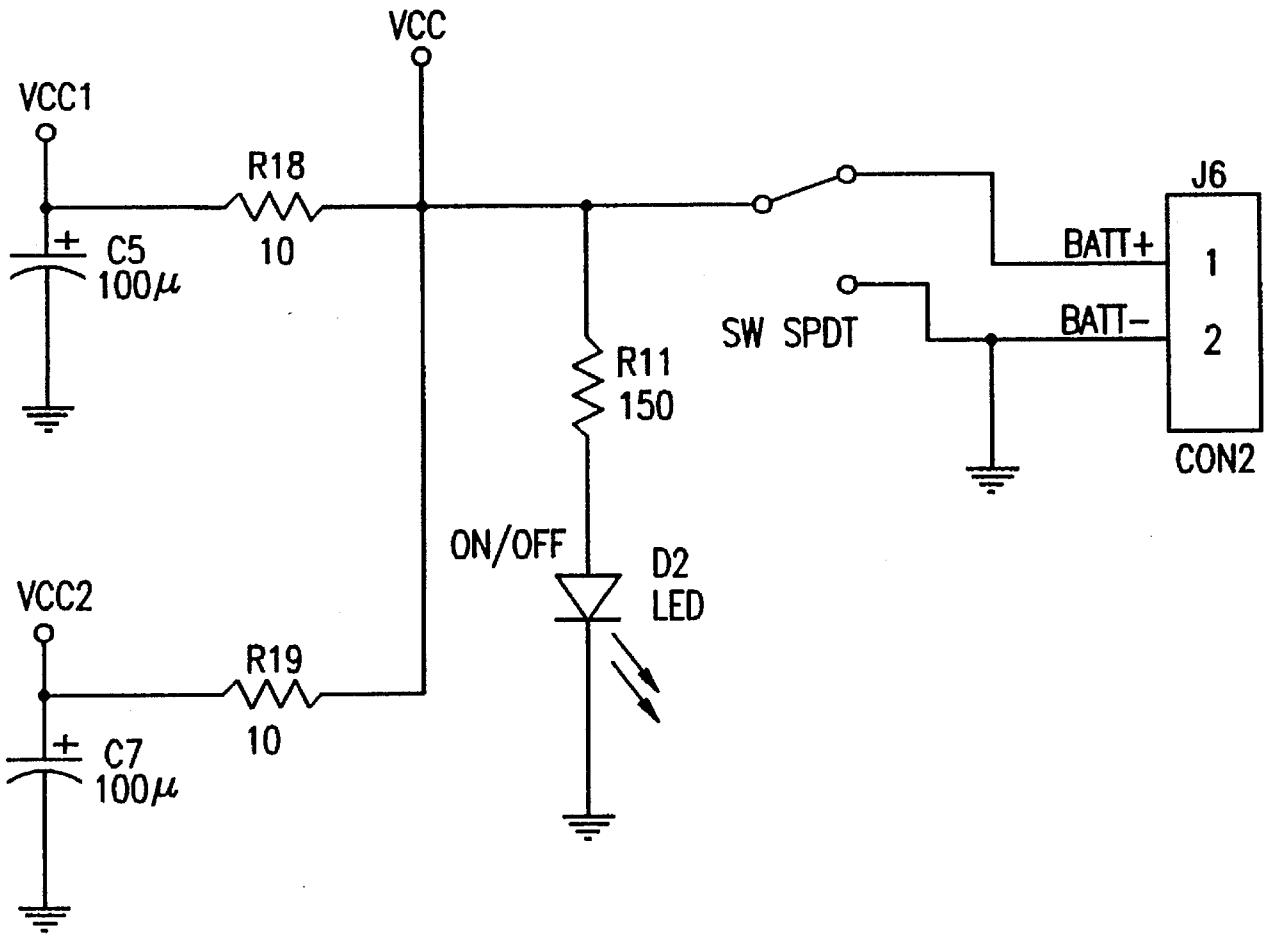

In accordance with a preferred embodiment of the present invention the audio output generator includes circuitry, a schematic of which is provided in FIGS. 7A–7C, which is operative to play the background music selected by depressing one of function switches 42, 44 and 46. Additionally, when switch 22 in microphone unit 20 is closed by propinquity of the microphone unit to magnetic material 14, the circuitry in the audio output generator is operative to provide a voice accompaniment to the selected background music in synchronization therewith, so as to simulate singing of the selected music by the doll.

Additionally in accordance with a preferred embodiment of the present invention the audio output generator 30 is operative to amplify sounds picked up by microphone 26 in microphone unit and output these sounds as an overlay to the selected background music. This may be done only when the microphone unit is not placed in propinquity to the mouth of the doll, i.e. when switch 22 is open, or alternatively at any time.

Figure 5:
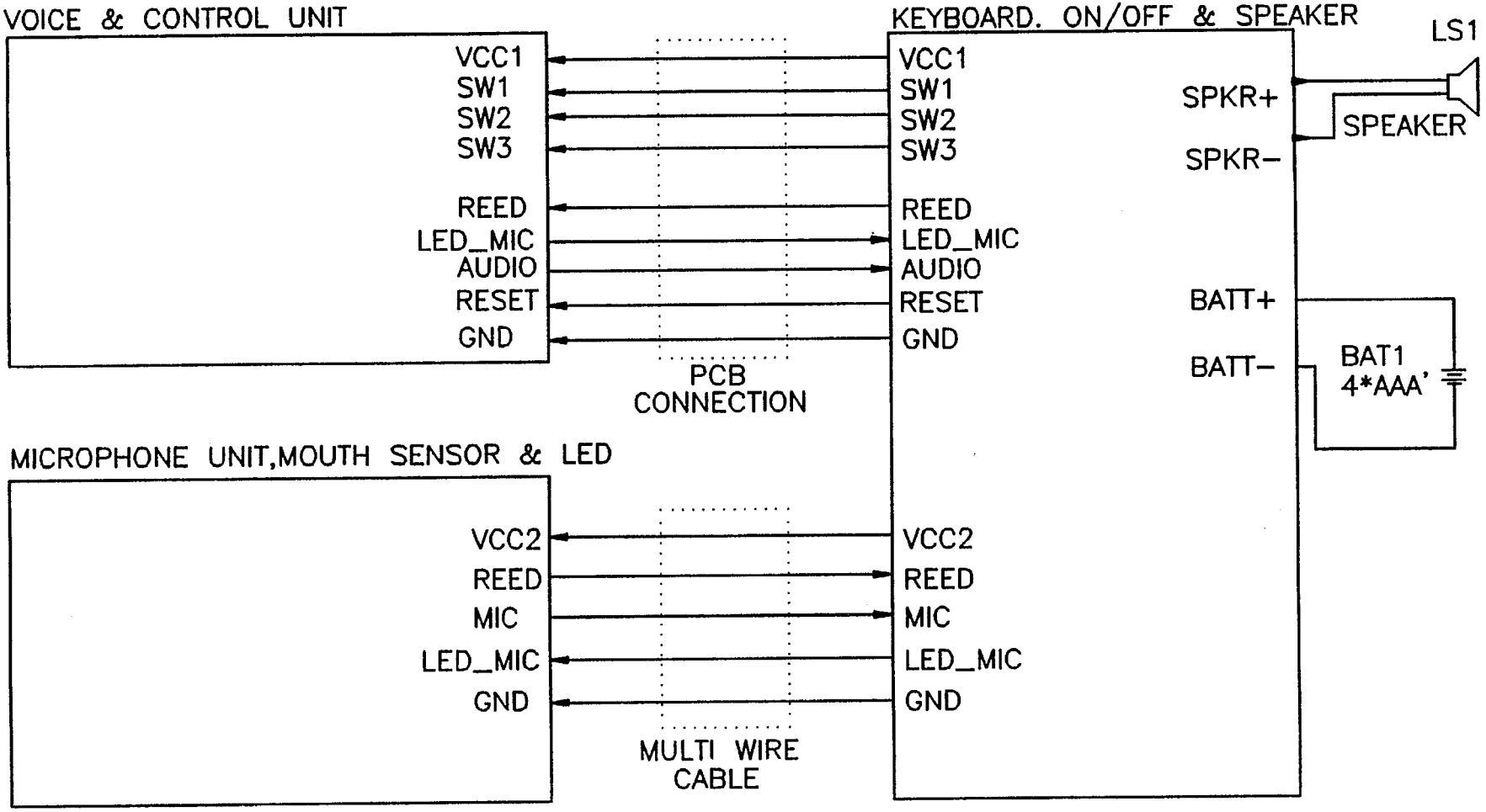
FIG. 5 is a general electrical block diagram of the doll toy assembly of FIGS. 1A–1D.
Figure 6:
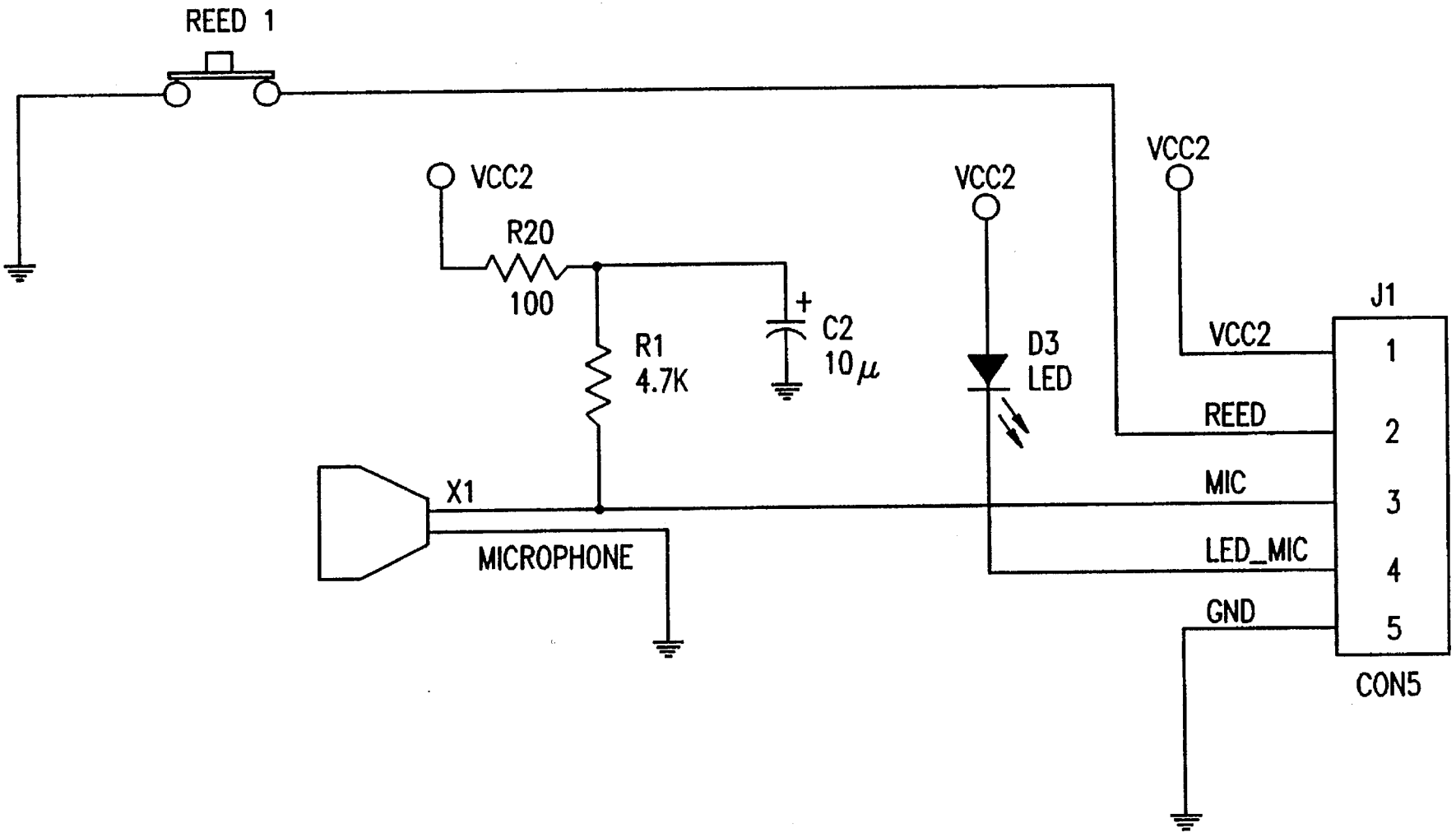
FIG. 6 is an electrical schematic of the microphone unit of FIG. 3.

FIG. 5 is a general block diagram of the doll 10, microphone unit 20 and audio output generator 30. FIG. 6 is an electrical schematic of microphone unit 20. FIGS. 7A, 7B and 7C form an electrical schematic of the circuitry of audio output generator 30. The circuitry includes inter alia a voice and music producing component, such as component TMP035 manufactured by Techno-Mind of Hong Kong, as seen in FIG. 7A.

The electrical schematic of FIGS. 5–7C are believed to be self-explanatory and thus no verbal description is provided, in the interest of conciseness.

Figure 8:
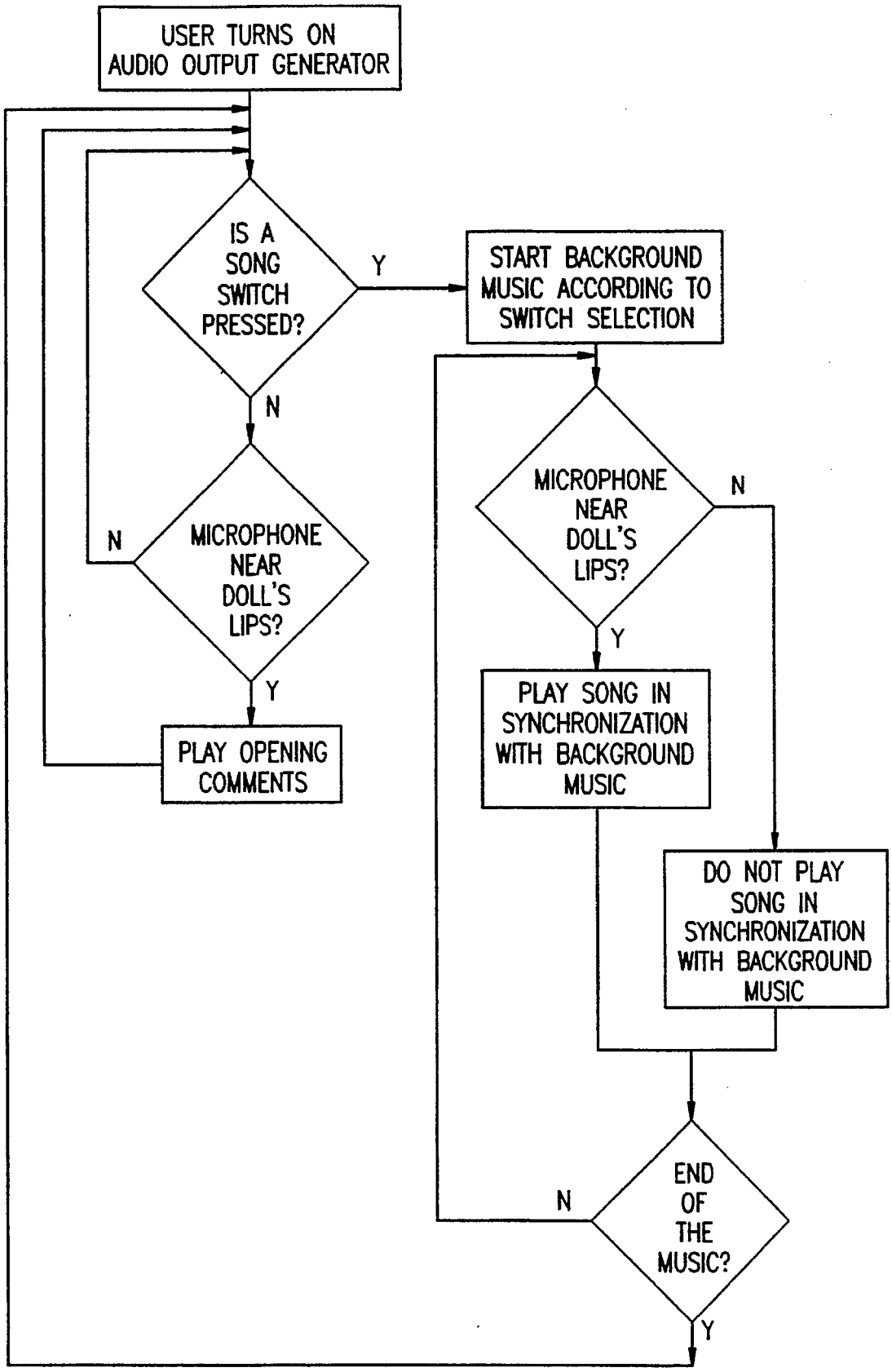
FIG. 8 is a simplified flow chart illustration of the operation of the apparatus of FIGS. 1–7C.

Referring now to FIG. 8, a brief explanation of the overall operation of the apparatus of FIGS. 1–7C will now be presented. The audio output generator 30 is turned on by means of ON/OFF switch 40. If a song selection switch, i.e. one of function switches 42, 44 and 46 is pressed, the selected background music is played. If the microphone unit 20 is brought into propinquity with the doll's lips 12, a foreground audio output is produced in time base synchronization with the background music and the output of LED 24 is modulated in accordance with the foreground audio output, causing the doll to appear to sing in synchronization with the selected background music.

If a song has not been selected, when the microphone is brought into propinquity with the doll's lips, certain prerecorded recorded opening comments are heard, as if spoken by the doll. During singing and/or speaking, the doll's lips are illuminated by the modulated light source in the microphone unit to create a sensation of moving lips.

If the microphone unit is located in or out of propinquity with the doll's lips and the user speaks or sings into the microphone unit, the user's voice is heard together with any selected background music.

It will be appreciated by persons skilled in the art that the present invention is not limited by what has been particularly shown and described hereinabove. Rather the scope of The present invention is defined only by the claims which follow:

We claim:

1. A synchronized audio output toy assembly comprising:

a toy figure; and an audio output generator operative to produce an audio output;

said audio output generator including:

at least first and second audio channels, said first audio channel being operative, when actuated, to provide a predetermined background audio output which is useful for time base synchronization, said second audio channel being operative, when actuated, to provide a predetermined foreground audio output in time base synchronization with said predetermined background audio output; and a user operative control including a propinquity switch operative to provide said predetermined foreground audio output in response to propinquity of a predetermined article to said toy figure.

2. A synchronized audio output toy assembly according to claim 1 and wherein said predetermined background audio output comprises music and said predetermined foreground audio output comprises voice.

3. A synchronized audio output toy assembly according to claim 1 and also comprising a microphone for receiving audio inputs and providing a microphone output to said audio output generator, said audio output generator being operative, when actuated, to provide an audio output of said audio inputs received by said microphone together with said predetermined background audio output.

4. A synchronized audio output toy assembly according to claim 2 and also comprising a microphone for receiving audio inputs and providing a microphone output to said audio output generator, said audio output generator being operative, when actuated, to provide an audio output of said audio inputs received by said microphone together with said predetermined background audio output.

5. A synchronized audio output toy assembly according to claim 3 and wherein said audio output generator is operative, when suitably actuated to simultaneously provide said predetermined foreground audio output, said predetermined background audio output and said audio output of said audio inputs received by said microphone.

6. A synchronized audio output toy assembly according to claim 4 and wherein said audio output generator is operative, when suitably actuated to simultaneously provide said predetermined foreground audio output, said predetermined background audio output and said audio output of said audio inputs received by said microphone.

7. A synchronized audio output toy assembly according to claim 5 and wherein said audio output generator includes a user operative control enabling said predetermined foreground audio output to be provided selectably with said predetermined background audio output.

8. A synchronized audio output toy assembly according to claim 6 and wherein said user operative control enables said predetermined foreground audio output to be provided selectably with said predetermined background audio output.

9. A synchronized audio output toy assembly according to claim 1 and wherein said toy figure is a figure having a mouth and wherein said assembly also comprises a modulated light source for illuminating said mouth, said modulated light source being illuminated in accordance with said foreground audio output.

10. A toy assembly according to claim 1 and wherein said toy figure includes:

a doll including a mouth and having magnetic material in the vicinity of the mouth; and said toy assembly also includes:

a microphone unit including a magnetically operated switch which is actuated when the microphone unit is placed in propinquity to the doll's mouth; and wherein said audio output generator is actuated by the magnetically operated switch.

11. A toy assembly according to claim 10 and wherein said microphone unit includes a light source which illuminates the vicinity of the doll's mouth when the microphone is actuated.

12. A toy assembly according to claim 11 and wherein said light source is a modulated light source which is illuminated in accordance with said foreground audio output.

13. A singing doll toy assembly including:

a doll including a mouth; and a microphone unit operating as an audio input device; and an audio output generator which is actuated by the microphone unit being placed in propinquity to the mouth of the doll, wherein the microphone unit includes a light source which illuminates the vicinity of the doll's mouth when the microphone unit is placed in propinquity to the mouth of the doll and the microphone unit also provides said audio input to said audio output generator.

14. A singing doll toy assembly according to claim 13 and wherein said light source is a modulated light source which is illuminated in accordance with an audio output of said audio output generator.

15. A singing doll toy assembly including:

a doll including a mouth; and a microphone unit; and an audio output generator operative to provide an output of music and to provide a synchronized overlay of prerecorded singing by the doll when the microphone unit is placed in propinquity to the mouth of the doll, and wherein said microphone unit is operative to pick up sounds produced by a user for amplification and output by the audio output generator.

16. Apparatus according to claim 15 and wherein said audio output generator includes user actuable controls enabling selection of music and voice outputs.

17. Apparatus according to claim 15 and wherein said doll is an entirely conventional doll having a magnet located in the vicinity of its mouth.

18. Apparatus according to claim 15 and wherein said magnet is located in an accessory which is removably located in the vicinity of the doll's mouth.

19. Apparatus according to claim 15 and wherein said audio output generator includes circuitry which is operative to play selected background music.

20. Apparatus according to claim 15 and wherein when the microphone unit is in propinquity with the doll's mouth, the audio output generator is operative to provide a voice accompaniment to selected background music in synchronization therewith, so as to simulate singing of the selected music by the doll.

21. A synchronized audio output toy assembly comprising:

a toy figure having a mouth;

an audio output generator operative to produce an audio output;

a microphone providing an audio input to said audio output generator; and a modulated light source mounted in said microphone for illuminating said mouth, said modulated light source being illuminated in accordance with said audio output.

* * * * *

UNITED STATES PATENT AND TRADEMARK OFFICE

CERTIFICATE OF CORRECTION

PATENT NO. : 5,603,652
DATED : February 18, 1997
INVENTOR(S) : Omri Rothschild; Roni Raviv It is certified that error appears in the above-indentified patent and that said Letters Patent is hereby corrected as shown below:

Column 1, line 10, change "incorporated" to -- incorporate --.
Column 2, line 19, replace "witch" with -- switch --.
Column 3, line 45, replace "which s" with -- which is --.
Column 4, lines 47,48, after "prerecorded" delete "recorded".
Column 4, line 59, before "present" change "The" to -- the --.

Signed and Sealed this

Twenty-first Day of April, 1998

Bruce Lehman

*Attest:*

BRUCE LEHMAN

*Attesting Officer*

*Commissioner of Patents and Trademarks*